US005335970A

United States Patent [19]

Bryant, deceased et al.

[11] Patent Number: 5,335,970

[45] Date of Patent: Aug. 9, 1994

[54] SWINGABLE CHAIR

[76] Inventors: James D. Bryant, deceased, late of Rockwall; by Sylvia L. Bryant, executrix, 307 Summit Ridge, Rockwall, both of Tex. 75087

[21] Appl. No.: 764,896

[22] Filed: Sep. 24, 1991

[51] Int. Cl.[5] ..... A47C 1/00

[52] U.S. Cl. ..... 297/344.22; 297/344.26; 248/282

[58] Field of Search ..... 297/349, 344, 13, 416, 297/421, 443, 414, 296, 352, 344.21, 344.1, 344.22, 344.26, 411.26, 411.27, 411.28, 411.44, 440.15; 16/276, 275; 248/415, 425, 418, 288.3, 282, 214, 240

[56] References Cited

U.S. PATENT DOCUMENTS

| | | | |
|---|---|---|---|
| 614,098 | 11/1898 | Gallagher | 16/276 |
| 1,156,834 | 10/1915 | Borland | 297/349 X |
| 1,298,216 | 3/1919 | Jenkins | 297/349 X |
| 2,021,242 | 11/1935 | Reyniers | 297/443 |
| 2,587,587 | 3/1952 | Bellezza et al. | 248/282 X |
| 2,604,144 | 7/1952 | Celizic | 297/296 |
| 2,672,644 | 3/1954 | Shamroth | 16/276 |
| 2,751,971 | 6/1956 | Gentsch | 297/414 X |
| 2,792,951 | 5/1957 | White | 297/349 X |
| 2,876,828 | 3/1959 | Mayer | 297/443 |
| 3,142,513 | 7/1964 | Skokut | 297/349 |
| 3,186,761 | 6/1965 | Propst | 297/349 |
| 3,275,283 | 9/1966 | Rauch | 297/349 X |
| 3,279,620 | 10/1966 | Nesbitt | 248/214 X |
| 3,323,144 | 6/1967 | Ferris, Jr. | 297/416 X |
| 3,393,009 | 7/1968 | Tart | 297/349 X |
| 3,718,365 | 2/1973 | Gibson | 297/344 |
| 3,910,633 | 10/1975 | Marsh | 248/418 X |
| 3,918,108 | 11/1975 | Feyerherm | 248/415 X |
| 4,391,466 | 7/1983 | Smith | 297/416 X |
| 4,722,567 | 2/1988 | Hashihara | 297/349 X |
| 4,775,313 | 10/1988 | DiIoia | 248/282 X |
| 4,998,305 | 3/1991 | Davis | 4/604 |

OTHER PUBLICATIONS

Page from an advertisement brochure (manufacturer of vendor unknown).

*Primary Examiner*—Kenneth J. Dorner
*Assistant Examiner*—Milton Nelson, Jr.
*Attorney, Agent, or Firm*—Baker & Botts

[57] ABSTRACT

A swingable chair mountable on a substantially vertical wall in a bathroom within close proximity to a bath tub or shower stall is provided. A chair with a seat, and a left and right armrest and a back detachably mounted on the seat is provided. There is at least one drainage opening in the seat and also a cushioning pad secured onto the seat. The chair is rotatably attached to a swing arm having an upper and lower extension. The upper arm extension joins the lower arm extension at an acute angle at one end and their free ends terminating a predetermined distance from one another. The lower arm extension extends substantially horizontally and is able to clear the bath tub or shower stall sill.

3 Claims, 3 Drawing Sheets

SWINGABLE CHAIR

TECHNICAL FIELD OF THE INVENTION

This invention relates in general to the field of body weight supporting apparatus, and more particularly, the present invention relates to a swingable chair.

BACKGROUND OF THE INVENTION

For a person having difficulty standing or moving about, such as a wheelchair-bound individual, the simple act of bathing presents a major task in everyday living. Most shower stalls and bath tubs are constructed with a barrier or sill which functions to retain and confine the bath water, but which acts as an insurmountable obstacle to a person dependent on a wheelchair as the only means of mobility. Unless special equipment is available and capable of hoisting the individual over the barrier, the individual is forced to resort to sponge baths and relying on others. Therefore, in our desire to make wheelchair-bound individuals more self-reliant and independent, it becomes important to provide a means to overcome this seemingly trivial obstacle.

Additionally for certain elders and the infirm, the act of stepping over the shower sill or tub side and balancing on one foot on the slick bathroom surfaces presents an especially hazardous opportunity for slipping and falling.

Accordingly, it is desirable to provide a weight supporting apparatus upon which a wheelchair-bound person is able to move and shift his body weight with relative ease, and which is capable of transporting the individual over the bath tub or shower stall sill, so that the individual may bathe within the confines of the shower stall or bath tub.

Furthermore, it is desirable to provide such a support as set forth above which is easily dismantled for storage when not in use. It is further desirable that any bracket that is used for attaching and supporting the apparatus has a sleek profile so that it does not disrupt the use of the shower stall or bath tub in an obtrusive manner.

It is further advantageous to provide a weight supporting apparatus adjustable with relative ease to accommodate varying needs of the user.

SUMMARY OF THE INVENTION

In accordance with the present invention, a swingable chair is provided which substantially eliminates or reduces disadvantages and problems associated with prior bathroom fixture support apparatus.

In one aspect of the present invention, a swingable chair mountable on a substantially vertical wall in a bathroom within close proximity to a bath tub or shower stall is provided. A chair is rotatably attached to a swing arm having an upper and lower extension. The upper arm extension joins the lower arm extension at an acute angle at one end and their free ends terminating a predetermined distance from one another. The lower arm extension extends substantially horizontally and is able to clear the bath tub or shower stall sill.

A first and second wall-mount bracket each having a substantially rigid and planar back portion and a substantially rigid and curved front portion are provided. The front and back portions are mounted against the wall with the back portion being immediately adjacent the wall and the front portion overlying and curving toward the back portion. A vertical slot is formed between the curved front portion and the back portion.

The first wall-mount bracket is mounted directly above and spaced from the second wall-mount bracket at a distance substantially equal to the predetermined distance between the ends of the upper and lower arm extensions. The swing arm is rotatably attached to a first and second bracket member. Each bracket member has an appendage adapted for insertion downwardly into the vertical slots of the first and second wall-mount brackets, so that the chair is pivotally swingable to a plurality of angular positions.

An important advantage of the present invention is that it provides the ability to effortlessly and readily upgrade any bath tub or shower stall so it is accessible to a wheelchair-bound individual.

An important technical advantage of the present invention provides an attachment arrangement which enables easy dismantling of the swingable chair when it is not in use. The attachment and removal of the swingable chair from the attachment arrangement does not have any moving parts which must be manipulated in order to free the swingable chair, nor is there any locking pin, bolts or similar small parts that may become lost easily.

Another important advantage of the present invention is the sleek profile of the attachment arrangement, which, when left in place after the removal of the swingable chair, does not prevent normal use of the shower stall or bath tub. Because of its slim profile, it does not impinge on the decor and function of the room in a obtrusive manner.

A further important advantage is the easy detachment of the armrests and chair back when their use is not desired. Reattachment of the armrests and chair back may be done with similar ease.

A still further important advantage of the present invention provides a swingable chair having a swing arm construction such that the chair is supported at an elevation low enough for access by a person in a wheelchair and yet high enough to swing the chair over the side of a bath tub.

Yet a further important advantage provided by the instant invention is the great range of swingability of the chair so that it may be positioned and repositioned readily to facilitate the task of hoisting oneself onto the chair. Furthermore, the wide range enables effortless positioning within the tub or stall.

A further important advantage is the provision for drainage in the chair seat in addition to soft seat cushioning that together provide a comfortable seating arrangement for the user while bathing.

BRIEF DESCRIPTION OF THE DRAWINGS

For a better understanding of the present invention, reference may be made to the accompanying drawings, in which.

DETAILED DESCRIPTION OF THE INVENTION

Figure 1:
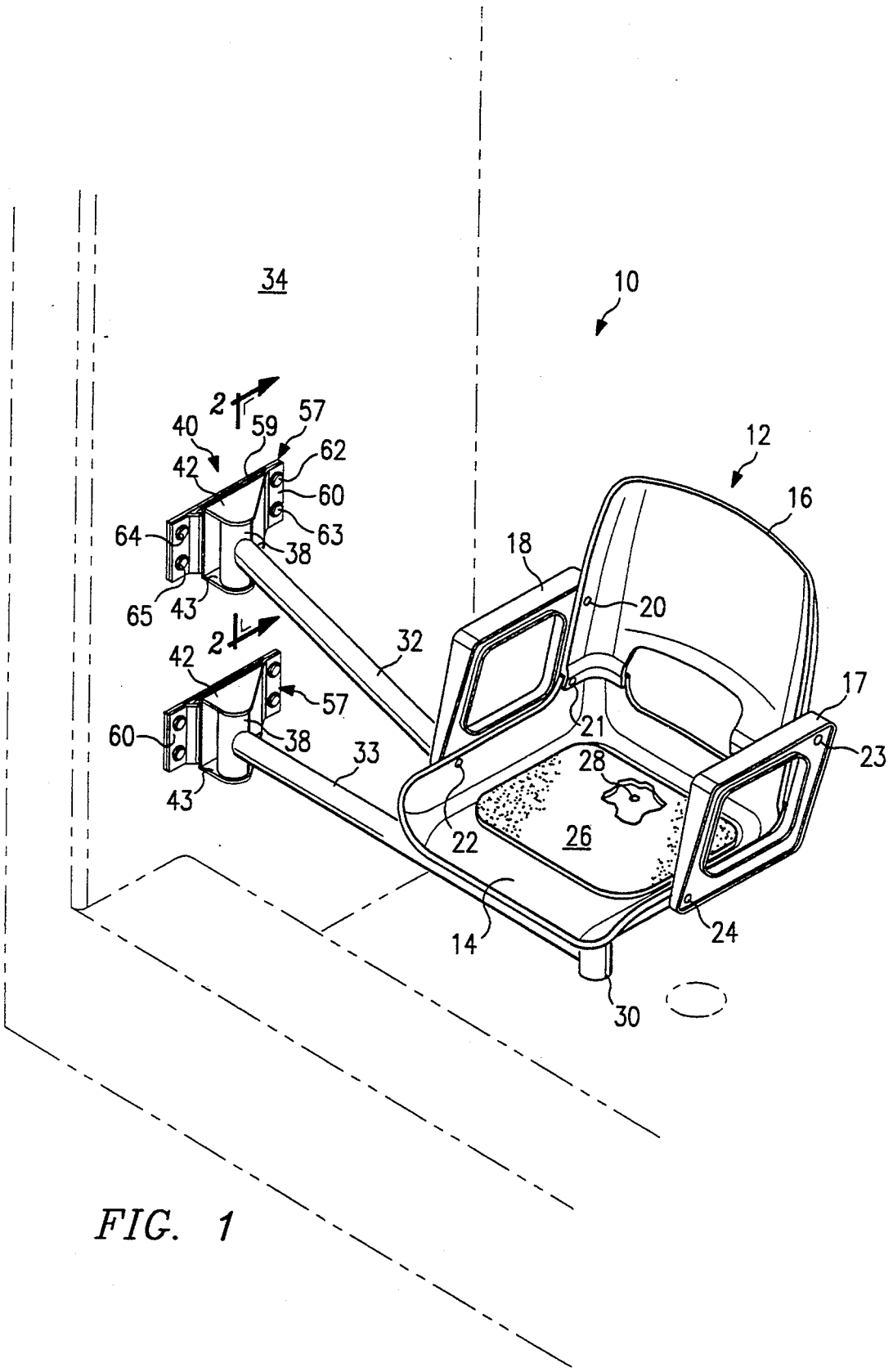
FIG. 1 is a perspective view of a preferred embodiment of the present invention installed in a bath tub.

With reference to the drawings, FIG. 1 illustrates a preferred embodiment of a swingable chair, indicated generally at 10 and constructed according to the teaching of the present invention. Swingable chair 10 includes a chair 12 with a seat 14, a detachable back 16, and armrests 17 and 18. Detachable back 16 and armrests 17 and 18 are secured onto seat 14 with fasteners 20–24, which are easily removable. Chair 12 may be constructed from any low weight and substantially rigid material, such as plastic. A cushioning mat 26 is secured in seat 14 to provide a more pliable seating surface. Cushioning mat 26 is preferably pervious to fluids, allowing drainage of bath water through a drain hole 28 in seat 14 and under mat 26.

Chair 12 is detachably mounted to a pin 30 which is firmly attached to one end of a swing arm 31 with an upper and a lower swing arm extension 32 and 33, respectively. The manner in which chair 12 is mounted to pin 30 is described in more detail below in conjunction with views shown in FIGS. 3 and 4. Swing arm extensions 32 and 33 form effectively a right triangle with the vertical wall 34 to which swingable chair 10 is mounted. Swingable chair 10 is mounted horizontally to wall 34 in a shower stall or bath tub so that lower swing arm extension 33 and pin 30 have ample clearance as chair 12 is swung over a shower stall sill or the side of a bath tub, as shown in phantom lines in FIG. 1. It is important to note that because lower arm extension 33 is horizontal, chair 10 is high enough to be swung in and out of a tub, and yet is at a level low enough to be accessible to a person in a wheelchair without assistance.

Figure 2:
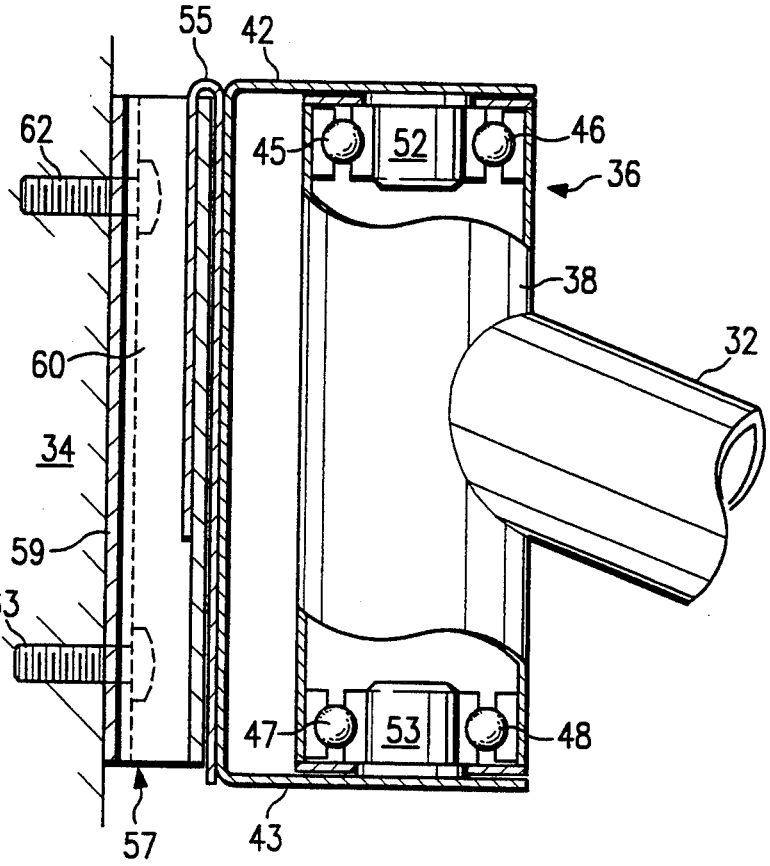
FIG. 2 is a cross-sectional view of the preferred embodiment of a wall mount arrangement taken along line 2—2.

Referring jointly to FIG. 2, where a cross-section of the preferred mounting arrangement of swingable chair 10 is shown. The mounting arrangement shown in FIG. 2 is applicable to both swing arm extensions 32 and 33. Upper swing arm extension 32 is shown attached to a cylindrical shaft 38 in which bearing assemblies 36 provide a rotatable contact between cylindrical shaft 38 and a bifurcated member or two supporting plates 42 and 43 of a bracket member 40. Bearing assemblies 36 include radial ball bearings 45–48 set in raceways and provide rotatable coupling between cylindrical shaft 38 and spindles 52 and 53, which are affixed to supporting plates 42 and 43 of bracket member 40, respectively. It is appreciated by one skilled in the art that any bearing configuration known in the art with a radial range of movement may be used herein.

Bracket member 40 further includes an appendage or a plate 55 coupled thereto for insertion into a slot formed in a wall-mount bracket 57. Wall-mount bracket 57 includes a generally flat plate 59 and a curved plate 60. Curved plate 60 lies directly over flat plate 59, and forms a slot therebetween which is adapted to receive plate 55 of bracket member 40. Both plates 59 and 60 are fastened together and to vertical wall 34 with fasteners such as screws 62–65 and the like. Constructed in this manner, upper and lower swing arm extensions 32 and 33 are detachably mounted to vertical wall 34, and the installation and removal of swingable chair 10 simply involve lifting chair 12 and/or swing arm 31, so that plates 55 attached to bracket members 40 of both upper and lower swing arm extensions 32 and 33 clear the slots in wall-mount brackets 57. Furthermore, swing arm 31 is angularly displaceable to a plurality of radial vertical planes extending from wall-mount bracket 57.

Figure 3:
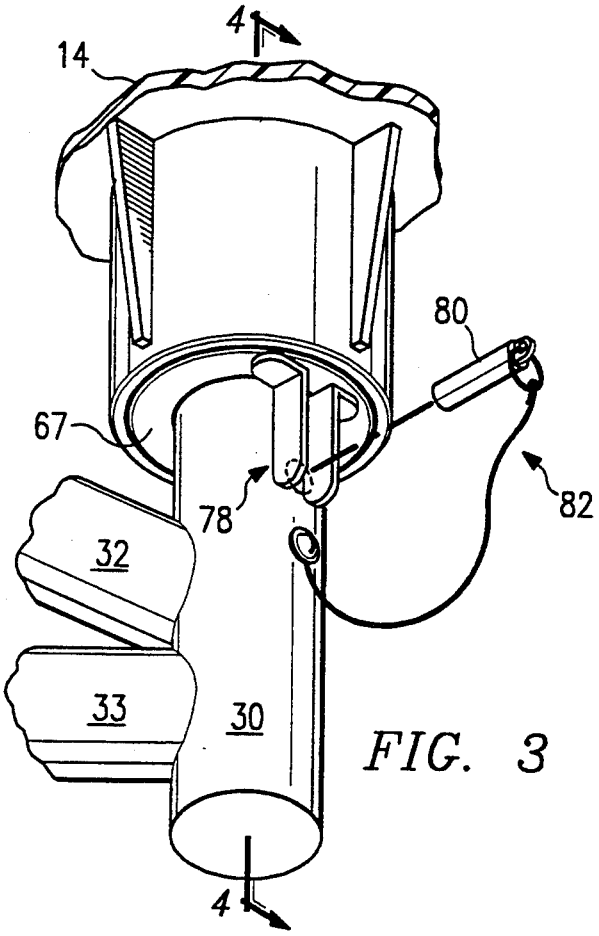
FIG. 3 is a perspective view of the preferred embodiment of a coupling arrangement of the swing arm and the underside of the chair.
Figure 4:
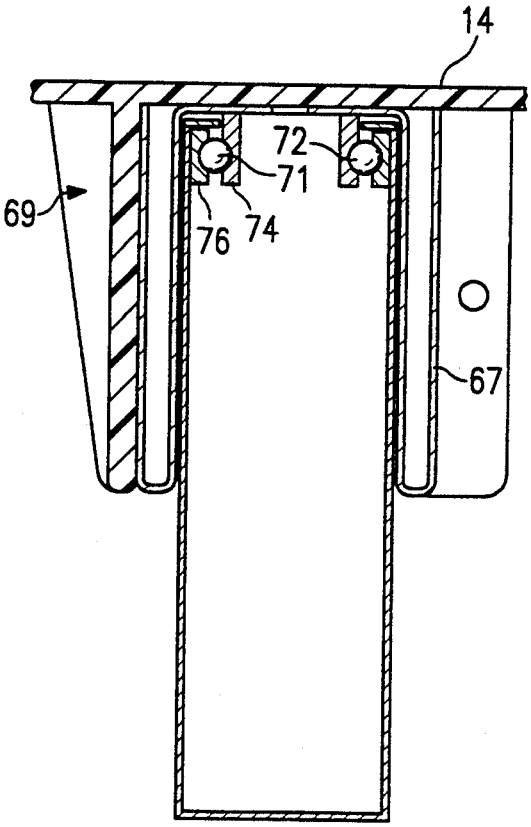
FIG. 4 is a cross-sectional view of the preferred embodiment of the coupling arrangement taken along line 4—4.

FIG. 3 provides a view of the coupling arrangement between chair 12 and pin 30 which is attached to upper and lower swing arm extensions 32 and 33. A socket 67 is formed on the underside of chair 12 below seat 14. Socket 67 is dimensioned to receive pin 30 so that chair 12 sits securely thereon. Referring also to FIG. 4, a cross-sectional view of pin 30 and socket 67 shows that a rotatable coupling is provided between seat 14 and pin 30. A bearing assembly 69 is arranged inside the upper end of pin 30. Ball bearings 71 and 72 are installed in a raceway provided between an inner race or a protruding member 74 and bearing housing 76. Inner race 74 protrudes slightly above the upper end of pin 30 to contact the bottom of seat 14 inside socket 67. Note that similar bearing constructions as known in the art which provide substantially the same function as described herein are contemplated by the present invention.

In operation, swingable chair 10 is easily installed in a shower stall or bath tub by fastening wall-mount brackets 57 to a substantially vertical wall. The distance between wall-mount brackets 57 must be approximately the same as the distance between bracket members 40, which are attached to the spaced apart ends of upper and lower swing arm extensions 32 and 33. After both wall-mount brackets 57 are installed, swing arm 31 can be mounted thereto by lifting swing arm 31 and positioning bracket members 40, so that plates 55 are in alignment with the slots formed by wall-mount brackets 57, and then lowering swing arm 31 to insert plates 55 into the slots. Chair 12 may then be mounted onto pin 30 by lowering it and allowing the upper end of pin 30 to be inserted into socket 67 formed in the underside of chair 12. Chair 12 may be adjusted by removing armrests 17 and 18 and detachable back 16 to suit individual preferences or needs. When the service of swingable chair 10 is not needed, it may be removed by simply lifting swing arm 31 and chair 12 to detach plates 55 from wall-mount brackets 57. Wall-mount brackets 57 may remain on the wall since their sleek profile is unobtrusive and does not interfere with normal usage of the bathing facility.

The functionality of swingable chair 10 is enhanced by providing means for preventing the rotation of chair 12 with respect to pin 30 once the desired rotational position is achieved. Referring to FIG. 3, a stay 78 is fashioned in the underside of seat 14 and a horizontal slot or orifice is formed in pin 30 to receive a latching pin 80. Latching pin 80 may be tethered to pin 30 by fastening means 82 to prevent misplacing it. More than one orifice may be formed in pin 30 to provide additional locking positions. The rotational locking of chair 12 may be preferable in allowing one confined to a wheelchair to hoist oneself onto swingable chair 10 without assistance from others.

Figure 5:
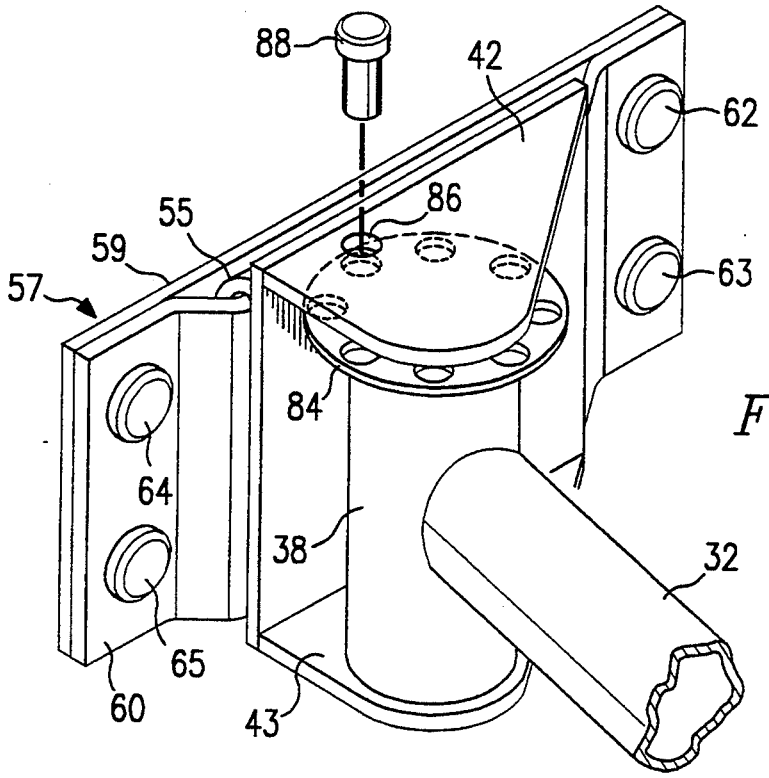
FIG. 5 is a perspective view of an embodiment of the swing arm locking arrangement.

FIG. 5 shows further enhancement to swingable chair 10 by providing a locking mechanism 84 for selectively maintaining chair 12 in one angular position with respect to wall-mount brackets 57. Locking mechanism 84 includes a circular plate with several apertures arranged radially thereon. An aperture 86 is further formed in supporting plate 42 of bracket member 40. A latching pin 88 is provided to be inserted into aperture 86 and one of the apertures in locking mechanism 84 to prevent upper and lower swing arm extensions 32 and 33 from swinging with respect to bracket member 40 and wall-mount bracket 57. Constructed with locking mechanism 84, swingable chair 10 may be more accessible because chair 12 will not swing out of reach or from beneath a person hoisting himself from a wheelchair.

Figure 6:
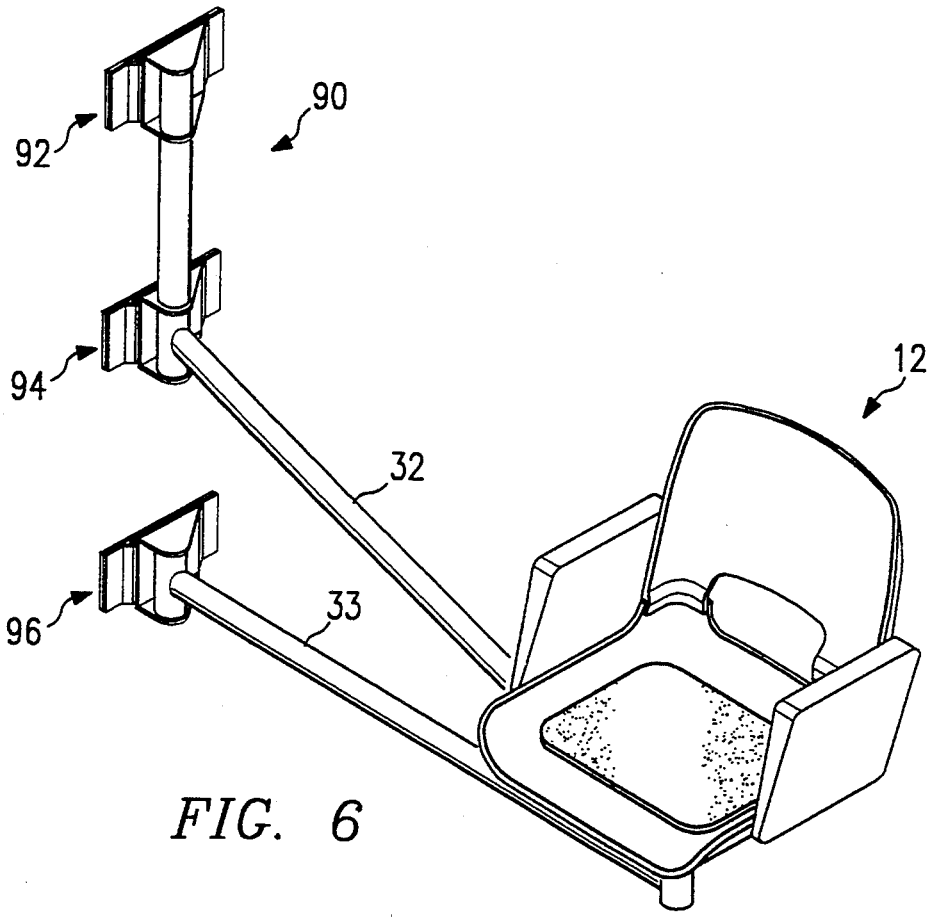
FIG. 6 is a perspective view of an alternate embodiment of the wall mount arrangement to support a long swing arm.

Referring to FIG. 6, a swingable chair 90 with a longer swing arm is provided. The swing arm includes longer arm extensions 92 detachably coupled to chair 12 in the same manner as described above in conjunction with FIGS. 3 and 4. Longer arm extensions 92 are also detachably coupled to bracket members and wall-mount brackets in a fashion similar to that described above. The additional wall-mount bracket and bracket member provide additional support to counteract the lever arm effect due to the longer swing arm. Swingable chair 90 may be employed where longer reach is needed.

Although the present invention has been described in detail, it should be understood that various changes, substitutions and alterations can be made thereto without departing from the spirit and scope of the present invention as defined by the appended claims.

What is claimed is:

1. A swingable chair mountable on a substantially vertical wall of a bathroom within close proximity to a bath tub or shower stall having a sill, comprising:

a seat;

a swing arm having an upper and lower extension, said upper arm extension joining said lower rm extension at an acute angle at one end, said seat being rotatably and detachably mounted on said joined ends of said arm extensions, said upper and lower arm extensions extending in spaced relationship in a substantially vertical plane, free ends thereof terminating a predetermined distance from one another, said lower arm extension being substantially horizontal with respect to said vertical wall;

a first and second wall-mount bracket each having a substantially rigid and planar back portion and a substantially rigid and curved front portion, each said wall-mount bracket being mountable against said wall with said respective back portion being immediately adjacent said wall and said respective front portion overlying and curving toward said respective back portion, said respective curved front portion and said respective back portion defining a vertical slot therebetween, said first wall-mount bracket being mounted on said wall directly above and spaced from said second wall-mount bracket at a distance substantially equal to said predetermined distance between said free ends of said upper and lower arm extensions, said lower wall-mount bracket being mounted at a point higher than said sill; and a first and second bracket member being pivotally coupled to said free ends of said upper and lower arm extensions respectively, each said bracket member having an appendage adapted for insertion downwardly into said vertical slots of said first and second wall-mount brackets, said seat and said arm extensions being simultaneously and pivotally swingable to a plurality of substantially vertical planes wherein the seat further comprises locking means for maintaining said seat and said arm extensions in at least one predetermined vertical plane and preventing the swing of said seat with respect to said wall-mount brackets, said locking means including a plate having at least one aperture at a predetermined position thereon and coupled to said swing arm, at least one of said first and second bracket members defining an aperture adapted for alignment with said aperture on said plate, and a latching pin for insertion into said apertures in said plate and said bracket member and maintaining said swing arm in a predetermined vertical plane with respect to said wall-mount brackets.

2. A chair pivotally mountable on a substantially vertical wall of a bathroom within close proximity to a bath tub or shower stall having a sill, comprising:

a first and second wall-mount bracket each having a substantially rigid and planar back portion and a substantially rigid and curved front portion, each said wall-mount bracket being mountable against said wall with said respective back portion being immediately adjacent said wall and said respective front portion overlying and curving toward said respective back portion, said mounted front and back portions defining a vertical slot therebetween, said first wall-mount bracket being mounted on said wall directly above said second wall-mount bracket and being a predetermined distance from said second wall-mount bracket, said lower wall-mount bracket being mounted at a point higher than said sill;

a first and second bracket member each having a appendage adapted for insertion downwardly into said vertical slots of said first and second wall-mount brackets respectively;

an arm having an upper and lower extension, one end of each of said upper and lower arm extensions being rotatively coupled to said first and second bracket members respectively, the other end of said upper arm extension joining the other end of said lower arm extension to form an acute angle extending in spaced relationship in a substantially vertical plane, said lower arm extension being substantially horizontal with respect to said vertical wall;

a chair having a seat, a left and right armrest, and a back portion being detachably mounted on said seat, said chair being rotatably and detachably mounted on said joined ends of said upper and lower arm extension, said chair and said swing arm being simultaneously and pivotally swingable to a plurality of substantially vertical planes; and locking means for maintaining said chair and said arm extensions in at least one predetermined vertical plane and preventing the swing of said chair with respect to said wall-mount brackets, said locking means including a plate having at least one aperture at a predetermined position thereon and coupled to said swing arm, at least one of said first and second bracket members defining an aperture adapted for alignment with said aperture on said plate, and a latching pin for insertion into said apertures in said plate and said bracket member and maintaining said swing arm in a predetermined vertical plane with respect to said wall-mount brackets.

3. A chair pivotally mountable on a substantially vertical wall of a bathroom within close proximity to a bath tub or shower stall having a sill, comprising:

a first and second wall-mount bracket each having a substantially rigid and planar back portion and a substantially rigid and curved front portion, each said wall-mount bracket being mountable against said wall with said respective back portion being immediately adjacent said wall and said respective front portion overlying and curving toward said respective back portion, said mounted front and back portions defining a vertical slot therebetween, said first wall-mount bracket being mounted on said wall directly above said second wall-mount bracket and being a predetermined distance from said second wall-mount bracket, said lower wall-mount bracket being mounted at a point higher than said sill;

a first and second bracket member each having an appendage adapted for insertion downwardly into said vertical slots of said first and second wall-mount brackets respectively;

a third bracket member having first and second opposing ends, said first end rotatably coupled to said upper extension at said first bracket member, said second end being coupled to a third wall-mount bracket for providing additional support;

a swing arm having an upper and lower extension, one end of each of said upper and lower arm extensions being rotatively coupled to said first and second bracket members respectively, the other end of said upper arm extension joining the other end of said lower arm extension to form an acute angle extending in spaced relationship in a substantially vertical plane, said lower arm extension being substantially horizontal with respect to said vertical wall; and a chair having a seat, optional left and right armrests, and an optional back portion being detachably mounted on said seat, said chair being rotatably and detachably mounted on said joined ends of said upper and lower arm extensions, said chair and said swing arm being simultaneously and pivotally swingable over and past said sill to a plurality of substantially vertical planes.

* * * * *